United States Patent [19]

Barkan

[11] 4,153,828

[45] May 8, 1979

[54] STORED-ENERGY OPERATING MEANS FOR AN ELECTRIC CIRCUIT BREAKER

[75] Inventor: Philip Barkan, Media, Pa.

[73] Assignee: General Electric Company, Philadelphia, Pa.

[21] Appl. No.: 703,328

[22] Filed: Jul. 8, 1976

[51] Int. Cl.[2] ..... H01H 3/30

[52] U.S. Cl. ..... 200/153 SC; 185/40 B; 200/153 V

[58] Field of Search ..... 200/153 SC, 153 V; 74/2; 192/33; 185/37, 40

[56] References Cited

U.S. PATENT DOCUMENTS

| | | | |
|---|---|---|---|
| 2,909,629 | 10/1959 | McCloud | 200/153 SC X |
| 3,590,192 | 6/1971 | Bould et al. | 200/153 SC |
| 3,689,721 | 9/1972 | McGuffie | 200/153 V |
| 3,729,065 | 4/1973 | Baskeville et al. | 200/153 SC |
| 3,794,798 | 2/1974 | Trayer | 200/153 V |
| 3,801,765 | 4/1974 | Hodgson | 200/153 SC |
| 3,876,847 | 4/1975 | Dykes et al. | 200/153 SC |
| 3,894,204 | 7/1975 | May | 200/153 SC |
| 3,905,247 | 9/1975 | Cook | 192/33 X |

*Primary Examiner*—Harold J. Tudor
*Attorney, Agent, or Firm*—William Freedman

[57] ABSTRACT

This operating means comprises a circuit-breaker closing spring, a rotatable spring-controller mounted for rotation between first and second dead-center positions with respect to said spring, and means for transmitting charging forces to the spring in response to rotation of the spring-controller in a forward direction from said second toward said first dead-center position. The spring acts to discharge and thereby further rotate said spring-controller in a forward direction when the spring-controller has been rotated in a forward direction past said first dead-center position. Discharge of the spring drives the spring-controller into said second dead-center position, following which the spring-controller oscillates about said second dead-center position to dissipate excess energy then remaining in the parts.

Means is provided for closing the circuit breaker in response to said forward rotation of the spring-controller into said second dead-center position, and this means comprises: a mechanically trip-free operating mechanism coupled to the movable contact of the circuit breaker and a linkage interconnecting said spring-controller and said operating mechanism through a pin and slot coupling. The pin and slot coupling (i) transmits closing force between the spring controller and the operating mechanism during spring-discharge, (ii) allows the spring-controller to oscillate about said second dead-center position without actuating the operating mechanism, and (iii) allows the spring-controller to be moved from said second to said first dead-center position during spring-charging without actuating said operating mechanism.

9 Claims, 6 Drawing Figures

STORED-ENERGY OPERATING MEANS FOR AN ELECTRIC CIRCUIT BREAKER

BACKGROUND

This invention relates to operating means for an electric circuit breaker and, more particularly, relates to stored-energy operating means that comprises a closing spring that can be quickly discharged to close the circuit breaker.

The particular operating means that we are concerned with comprises a rotatable spring-controller mounted for rotation between first and second angularly-spaced dead-center positions with respect to the closing spring. The spring is charged by rotating the spring-controller in a forward direction between said second and said first dead-center positions. Circuit-breaker closing is effected after such charging of the spring by allowing the spring to discharge and drive the spring-controller in a forward direction into its second dead-center position.

It is conventional to transmit closing forces between the spring-controller and the usual operating mechanism of the circuit breaker through a rotatable cam. Such cams, while adequate to perform this function, are expensive to manufacture inasmuch as they require a precisely-contoured hardened working surface.

SUMMARY

A general object of my invention is to eliminate the need for such a cam in this type of circuit-breaker operating means.

A more specific object is to transmit closing forces between the spring-controller and the operating mechanism by means of a special linkage that effectively utilizes the spring-controller's passage through a dead-center position with respect to said linkage at the end of a circuit-breaker closing stroke.

Another object is to dissipate any excess kinetic energy in the parts of the circuit breaker at the end of a closing stroke by allowing the spring-controller to oscillate about said second dead-center position at the end of the closing stroke and, more specifically, to so oscillate without actuating the circuit-breaker operating mechanism.

Still another object is to provide between the spring-controller and the operating mechanism a force-transmitting linkage that is devoid of the above-described cam but is capable of allowing the spring-controller to undergo the above-described oscillations at the end of a closing stroke without actuating the circuit-breaker operating mechanism.

In carrying out the invention in one form, I provide a circuit-breaker operating device comprising a circuit-breaker closing spring, a rotatable spring-controller mounted for rotation between first and second dead-center positions with respect to said spring, and means for transmitting charging forces to the spring in response to rotation of the spring-controller in a forward direction from said second toward said first dead-center position. The spring acts to discharge and thereby further rotate the spring-controller in a forward direction when the spring-controller has been rotated in a forward direction past said first dead-center position. Releasable stop means blocks said further forward rotation of the spring-controller and can be released subsequently to permit the spring to rapidly discharge and continue forward rotation of the spring-controller into said second dead-center position. Immediately following this rapid discharge of the spring, the spring-controller oscillates about said second dead-center position.

Means is provided for closing the circuit breaker in response to said forward rotation of the spring-controller into said second dead-center position, and this means comprises: (a) a mechanically trip-free operating mechanism coupled to the movable contact of the breaker, (b) a linkage interconnecting said spring-controller and said operating mechanism, and (c) a pin and slot coupling between said linkage and said operating mechanism. The pin and slot coupling (i) transmits closing force between the spring-controller and the operating mechanism during forward rotation of said spring-controller into said second dead-center position, (ii) allows the spring-controller to oscillate about said second dead-center position at the end of a closing operation without actuating said operating mechanism, whereby the breaker can remain closed despite said oscillations, and (iii) allows said spring-controller to be forwardly moved from said second to said first dead-center position without actuating said operating mechanism, whereby the breaker can remain closed during said charging of the closing spring.

BRIEF DESCRIPTION OF DRAWINGS

For a better understanding of the invention, reference may be had to the accompanying drawings wherein.

FIG. **4*a* shows a detail of the operating means of FIGS. 1–4, which detail is not depicted in FIGS. 1–4**.

Figure 5:
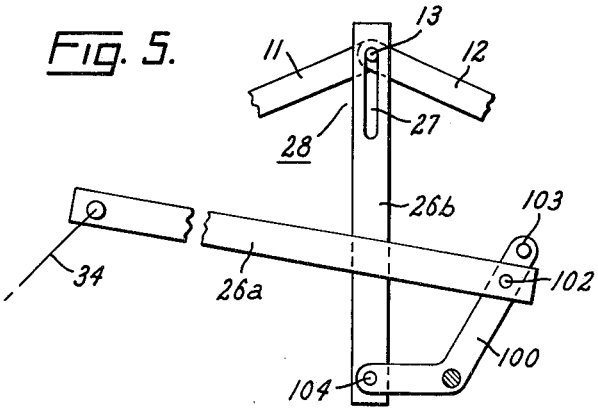

FIG. 5 illustrates a modified form of the invention.

DETAILED DESCRIPTION OF PREFERRED EMBODIMENT

Figure 1:
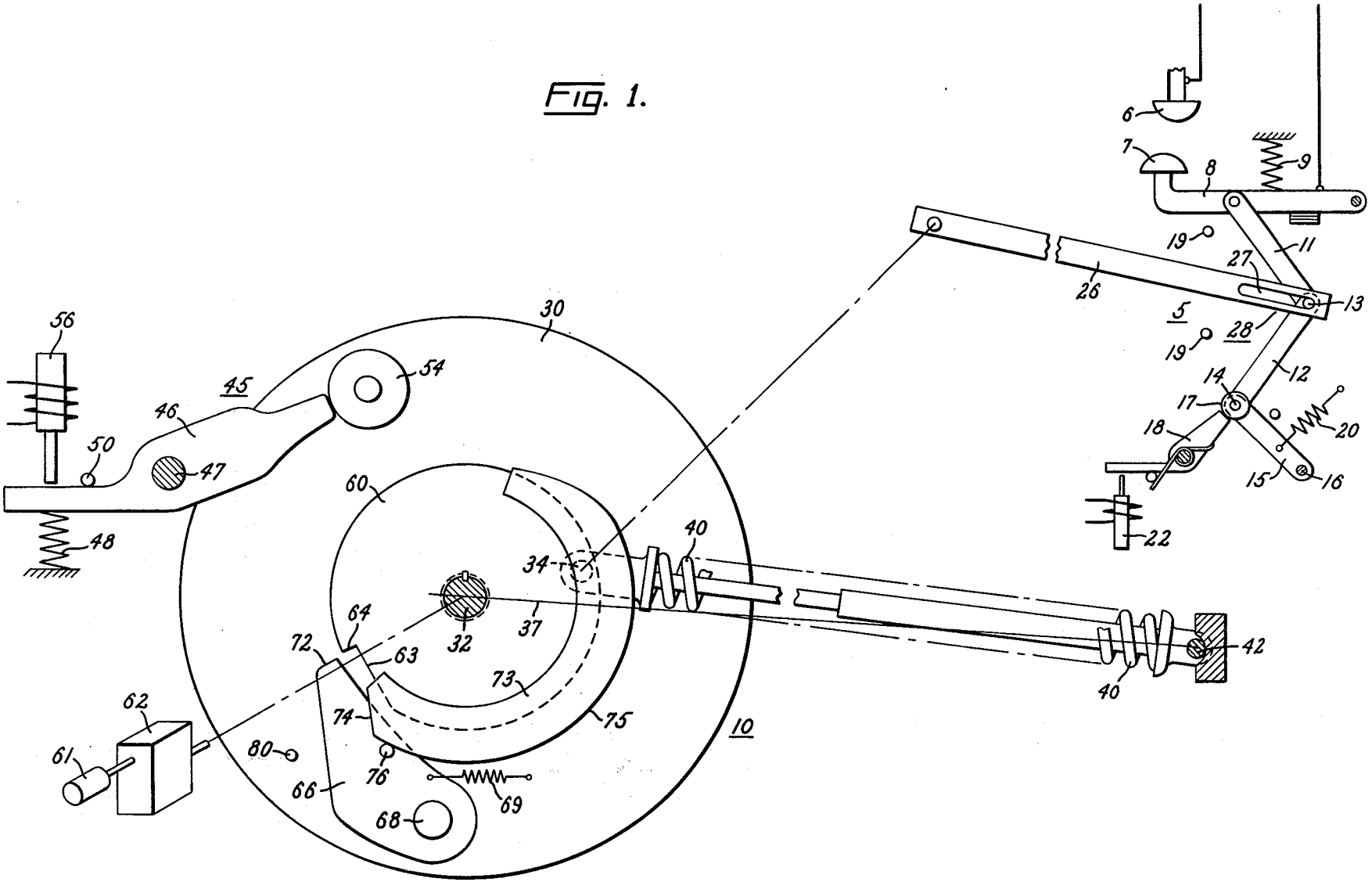
FIG. 1 is a schematic showing of my circuit breaker operating means depicting the parts in a position where the circuit breaker is open, the closing spring is fully charged, and the charging motor is coasting to a halt immediately following its deenergization.

Referring now to FIG. 1, the operating mechanism for the circuit breaker is shown at 5 and the stored-energy device for imparting closing force to the mechanism is shown at 10. The operating mechanism can be of any suitable conventional type and is therefore shown in simplified schematic form. For simplicity, its size relative to that of the operating device has been reduced.

THE CIRCUIT BREAKER OPERATING MECHANISM 5

As shown in FIG. 1, the circuit breaker comprises a pair of relatively movable contacts 6 and 7. Contact 6 is a stationary contact, and contact 7 is a movable contact carried by pivotally mounted contact arm 8 biased to the open position shown in FIG. 1 by a suitable opening spring 9. Closing forces are transmitted to the movable contact arm 8 by a conventional mechanically trip-free operating mechanism which comprises a pair of toggle links 11 and 12 pivotally joined together by a knee 13.

One of the toggle links 11 is pivotally connected at its opposite end to the movable contact arm 8, whereas the other of the toggle links 12 is connected by a pivot pin 14 to the left hand end of a guide link 15. Guide link 15 is pivotally supported at its right hand end on a fixed fulcrum 16. Pivot pin 14 carries a latch roller 17 which cooperates with a suitable trip lactch 18. So long as trip latch 18 remains in its latched position shown, toggle 11, 12 is capable of transmitting thrust to the movable contact arm 8. Thus, when the knee 13 is driven to the left from its position of FIG. 1, toggle 11, 12 is extended toward an in-line position and thus drives the movable contact arm upwardly toward its closed position of FIG. 2.

Closing force is transmitted to the toggle knee 13 through a link 26. A pin and slot coupling 28, is provided between link 26 and the operating mechanism 5. This coupling comprises a slot 27 in the link 26 and an extension of knee 13 acting as the pin portion of the coupling and fitting slidably within the slot 27. Link 27 is pivotally mounted on crank pin 34 (soon to be described).

When link 26 is driven to the left, it acts through coupling 28 to extend the toggle 11, 12, as above described. During this motion of link 26, the right hand end of slot 27 bears against knee pin 13. Preferably, link 26 is arranged to drive toggle 11, 12 slightly overcenter and against stops 19 so that the movable contact will be held in its closed position even when the link 26 is returned to its original position of FIG. 1.

Should latch 18 be tripped when the circuit breaker is closed or even during a closing stroke, toggle 11, 12 will be rendered inoperative to transmit closing thrust to movable contact arm 8. As a result, the opening spring 9 will be free to drive movable contact arm 8 to its open position of FIG. 3, where the mechanism is shown not yet reset. A suitable reset spring 20 cooperates with guide link 15 to reset the mechanism to its latched, thrust-transmitting condition of FIG. 1 after it has been tripped. The above-described tripping of latch 18 is accomplished in response to predetermined electrical conditions by operation of a suitable tripping solenoid 22.

THE STORED-ENERGY OPERATING DEVICE 10

For driving link 26 from its position of FIG. 1 to the left to produce the above-described closing of the circuit breaker, the stored-energy operating device 10 is relied upon. This operating device 10 comprises a rotatable flywheel 30, occasionally referred to herein as a spring-controller. Flywheel 30 is freely rotatable on a centrally-located shaft 32 and includes a crank pin 34 fixed thereto at a point spaced radially from the axis of the shaft 32. The above-described link 26 is pivotally connected to this crank pin 34.

Cooperating with flywheel 30 is a heavy compression spring 40 that has one end pivotally connnected to crank pin 34 and its other end pivotally mounted on a pivot 42 that normally has a stationary axis. Flywheel 30 has two different dead-center positions with respect to spring 40. In a first one of these dead-center positions, the axis of crank pin 34 is located between the axis of shaft 32 and the axis of pivot pin 42 and on a reference line 37 interconnecting these latter two axes. In a second one of these dead-center positions, the axis of crank pin 34 is located on the same reference line 37 but on the opposite side of the axis of shaft 32.

In FIG. 1 the parts are depicted in a position wherein the crank pin 34 has been driven in a counterclockwise, or forward, direction slightly past the first dead-center position. Spring 40 is essentially fully charged and is biasing flywheel 30 in a counterclockwise direction but is blocked from discharging by a releasable stop 45. This releasable stop 45 comprises a prop latch 46 that is pivotally mounted on a stationary pivot 47. A compression spring 48 biases prop latch 46 into a set position against a fixed stop 50. In FIG. 1 the prop latch 46 is positioned in interfering relationship with a roller 54 carried by flywheel 30. Release of stop 45 is effected by means of a closure-initiating solenoid 56, which upon energization drives prop latch 46 in a counterclockwise direction out of interfering relation with roller 54.

Figure 2:
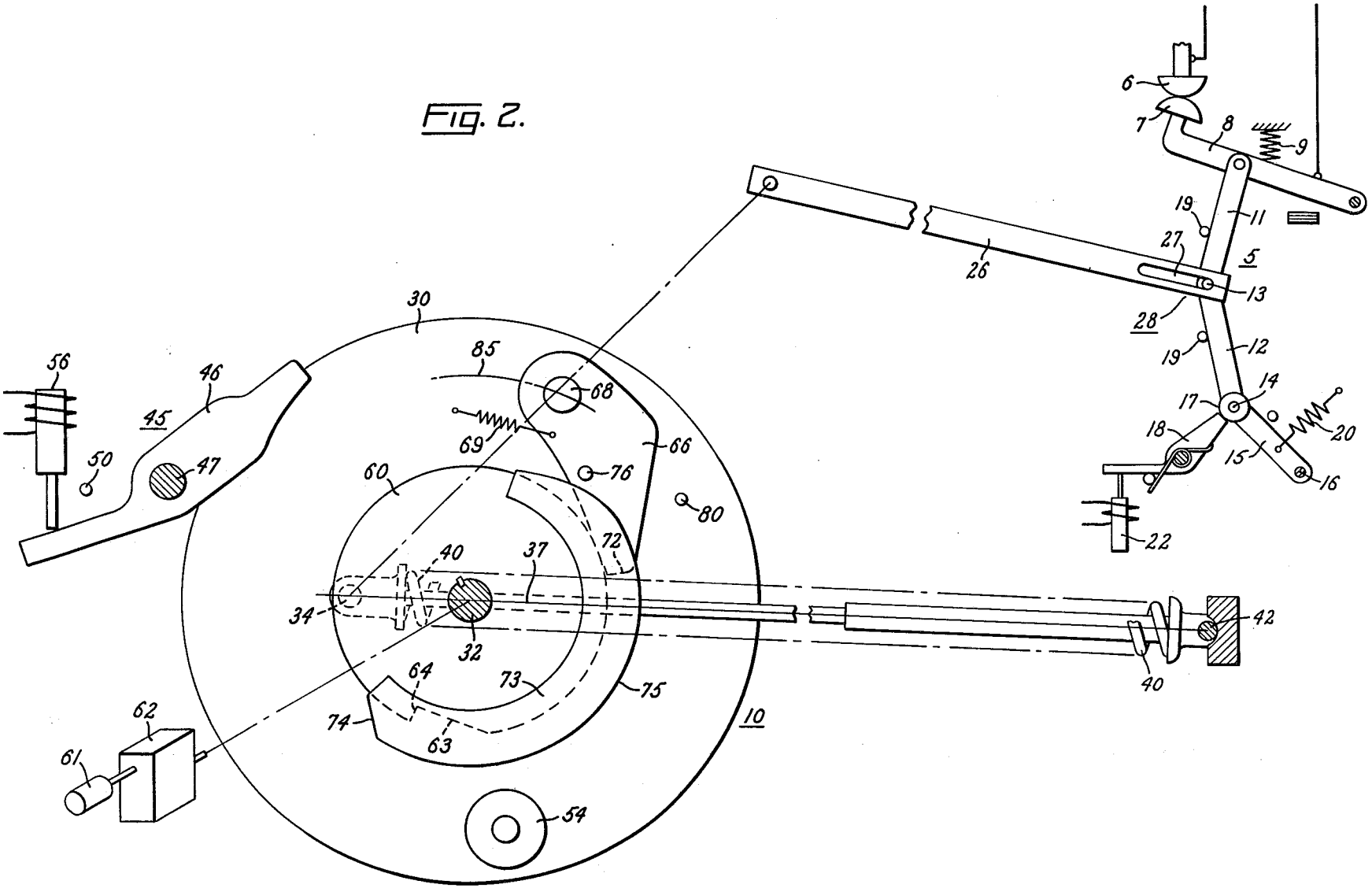
FIG. 2 is a schematic showing depicting the parts immediately after the spring has discharged and effected closing of the circuit breaker.

When stop 45 is thus released, main compression spring 40 is free to drive flywheel 30 in a counterclockwise direction from its position of FIG. 1 into its second dead-center position, which is shown in FIG. 2. This counterclockwise motion of flywheel 30 is transmitted to link 26 through crank pin 34 and acts to drive link 26 through a circuit-breaker closing stroke.

Compression spring 40 is recharged after the above-described discharge by driving flywheel 30 in a counterclockwise, or forward, direction from its position of FIG. 2 into its position of FIG. 1. During this recharging motion, the connecting link 26 moves to the right from its position of FIG. 2 into its position of FIG. 1, but this motion of link 26 has no effect on the toggle 11, 12 since the slot 27 in link 26 allows this motion to occur without transmitting force to knee pin 13. For driving flywheel 30 through this recharging motion, a rotatable driving member 60 is provided. This driving member 60 is keyed to the shaft 32 on which the flywheel is freely rotatable mounted. Shaft 32 is coupled to a small electric motor 61 through conventional reduction gearing 62. The motor is controlled in a conventional manner by a suitable control circuit (not shown), the operation of which will soon appear more clearly.

Driving member 60 has a circular periphery except for a notch 63 provided therein, which notch results in an abutment 64 being present on the driving member 60. This abutment 64 cooperates with a pawl 66 carried by flywheel 30. Pawl 66 is pivotally mounted on a pin 68 fixed to flywheel 30 and is biased in a clockwise direction about pin 68 by a suitable spring 69. The pawl 66 has a working surface 72 that under certain conditions is engageable with abutment 64 to transmit driving motion between driving member 60 and flywheel 30. When driving member 60 is rotated in a counterclockwise direction from its position of FIG. 2, no driving force is transmitted to the flywheel 30 until the abutment 64 reaches a position of angular alignment with working surface 72 on pawl 66. When this position is reached, the pawl 66 is in notch 63 and the abutment 64 engages the working surface 72 of the pawl and thereafter transmits driving force through the pawl 66 to flywheel 30, thus producing counterclockwise spring-charging motion of the flywheel.

This counterclockwise spring-charging motion of the flywheel 30 is continued for slightly more than 180° until the flywheel is returned to its position of FIG. 1, where it is blocked by the stop 45. Such counterclockwise motion of the flywheel charges spring 40 until the previously-described first dead-center position is reached. Thereafter, flywheel 30 passes in a counterclockwise directions lightly beyond this dead-center position (typically about 10°) and into its overcenter, blocked position of FIG. 1.

RELEASE OF PAWL 66 FROM ABUTMENT 64 BY CAM 73

To prevent damage to the parts of the device when roller 54 on flywheel 30 encounters stop 45 after a spring-charging operation, the pawl 66 is released from driven relationship with abutment 64 immediately after the first dead-center position has been reached but just prior to the roller's engaging the prop latch 46. Such release of pawl 66 is effected by cam means comprising a stationary cam member 73 of generally arcuate from. The outer surface 74 of this cam member cooperates with a follower pin 76 on pawl 66 and lifts pawl 66 radially-outwardly into a retracted position with respect to abutment 64 just before stop 45 is encountered. The parts are depicted in FIG. 1 just after such pawl-release has occurred and at the instant that the roller 54 encounters prop latch 46. Just prior to this instant, the motor 61 is deenergized by a suitable cut-off switch (not shown) responsive to position of the driving member 60, following which the motor and the driving member 60 coast to a gradual stop. The precise position at which the driving member 60 stops following such coasting is not critical, provided only that it is within the region protected by the cam 73, as will soon appear more clearly. Typically, this final position of the driving member 60 will be 30 to 60 degrees past the position shown in FIG. 1.

OSCILLATIONS OF FLYWHEEL 30 AT THE END OF A CLOSING OPERATION

When the stop 45 is later released to initiate closing of the circuit breaker 12, the spring 40 drives spring-controller 30 counterclockwise into its position of Fig. 2. The amount of excess kinetic energy remaining in the spring-driven parts after this closing opration will depend upon variations in electromagnetic and frictional forces and normal tolerance variations in spring forces. Any such excess energy remaining will carry the flywheel 30 past the dead-center position of FIG. 2 through additional forward rotation, thus partially recharging spring 40. Immediately after this partial recharging, the spring again discharges, this time driving the flywheel in a reverse direction through the dead-center position of FIG. 2 and again partially recharging the spring. Immediately thereafter, the spring again discharges to drive flywheel 30 in a forward direction through the dead-center position of FIG. 2. These oscillations of the flywheel about its dead-center position of FIG. 2 continue at high speed, but with decreasing amplitude, until the excess energy is finally dissipated and the flywheel comes to rest in its dead-center position of FIG. 2.

PROTECTING AGAINST POSSIBLE COLLISIONS RESULTING FROM OSCILLATIONS

A problem presented by these oscillations of the flywheel is that, under certain conditions, they can carry the flywheel in a reverse direction through sufficient travel to produce a damaging collision between the pawl 66 and abutment 64 unless special protection against such collisions is provided. As pointed out in the copending Barkan application Ser. No. 702,328, which has issued as U.S. Pat. No. 4,110,582, the cam 73 is relied upon as the principal means for providing such protection.

In this respect, when the flywheel 30, in traveling in a reverse direction during such oscillations, carries the follower pin 76 back onto surface portion 75 of the cam 73, the pawl 66 is again retracted counterclockwise about its pivot 68. So long as the pawl 66 is so retracted, its working face 72 cannot engage the abutment 64, and thus damaging collisions between the pawl 66 and the abutment are prevented. The collision-preventing surface 75 of cam 73 (i.e., the constant radius portion of the cam surface that holds the pawl in its retracted position where its working face 72 cannot engage abutment 64) extends around the central axis of the flywheel by about 170°. Thus, even if the above-described oscillations should carry the flywheel through as much as 170° in a reverse direction from its dead-center position of FIG. 2, the cam 73 will be capable of preventing a collision between the pawl 66 and abutment 64 during such reverse travel.

The driving member 60 is driven by motor 61 in a counterclockwise direction shortly after the above-described spring-discharge to commence a spring-charging operation. A typical position of the driving member 60 at the start of such a recharging operation is shown in FIG. 2. After the driving member 60 has been driven counterclockwise through approximately 135° from its position of FIG. 2, the abutment 64 on the driving member engages the working face 72 of pawl 66 and drives the pawl together with the flywheel 30 through a charging stroke into their position of FIG. 1.

During a recharging operation, motor 61 drives driving member 60 at a relatively low speed compared to the speed of the flywheel during spring-discharge. Typically, several seconds are required before the motor can drive driving member 60 through approximately the $\frac{1}{3}$ to $\frac{1}{2}$ revolution required to produce engagement between abutment 64 and pawl 66. This is a sufficiently long period to assure that the above-described oscillations of the closing spring have damped out by the time abutment 64 reaches the pawl 66 and begins transmitting recharging energy from the motor to the spring.

THE PIN AND SLOT COUPLING 28

The pin and slot coupling 28 serves a number of important functions in addition to transmitting closing force between closing device 10 and the operating mechanism 5 during a closing operation. First of all, this coupling 28 allows the spring controller 30 to oscillate at the end of a closing stroke, as hereinabove described, without actuating the then-closed operating mechanism 6, thus allowing the circuit breaker to remain closed despite these oscillations. In addition, the pin and slot coupling 28 allows for the above-described subsequent recharging of the closing spring by forward rotational motion of the spring controller 30 from its dead-center position of FIG. 2 into its position of FIG. 1 without affecting the then-closed operating mechanism 5. Assuming the circuit breaker remains closed during such recharging, the slot 27 simply moves to the right during such recharging while the knee pin 13 remains stationary.

There are several cooperating features which make possible the above-described independence of the operating device 10 and the operating mechanism 5 during these oscillations of the spring controller 30. One is the clearance with respect to pin 13 provided by slot 27 in the direction of the slot link. Another is the fact that these oscillations produce no further movement of link 26 in a closing direction (i.e., to the left) beyond the position occupied by the link when it has driven the circuit breaker closed (i.e., the position of FIG. 2). During these oscillations, the right hand end of slot 27 moves through travel located entirely to the right of the position occupied by knee pin 13 when the circuit breaker is closed, thus preventing interference between pin 13 and the right end of the slot during these oscillations.

This latter feature is closely tied in with the fact that spring controller 30 is in a dead-center position with respect to the connecting link 26 when the circuit breaker operating mechanism reaches its fully-closed position. This is best illustrated in the schematic showing of FIG. 4, where operating mechanism 5 is shown fully-closed and the counterclockwise-moving spring-controller 30 has entered a dead-center position with respect to link 26 but has not yet quite reached its dead-center position with respect to the spring 40. Angular motion of the spring controller 30 on either side of the position of FIG. 4 (as during the above-described oscillations) will cause the right-hand end of slot 27 to move through travel located entirely to the right of knee pin 13, and there will therefore be no interference between pin 13 and the right-hand end of the slot 27 during these oscillations.

It will be apparent that the hereinabove-described pawl-releasing cam 73 coacts with the pin-and-slot coupling 28 to prevent harmful impacts during the above-described oscillations of the spring controller 30. More specifically, during these oscillations, the cam 73 effectively uncouples the spring-controller 30 from the relatively movable elements on its input side, whereas the slot 27 effectively uncouples the spring-controller from the then-stationary operating mechanism 5 on its output side.

Figure 3:
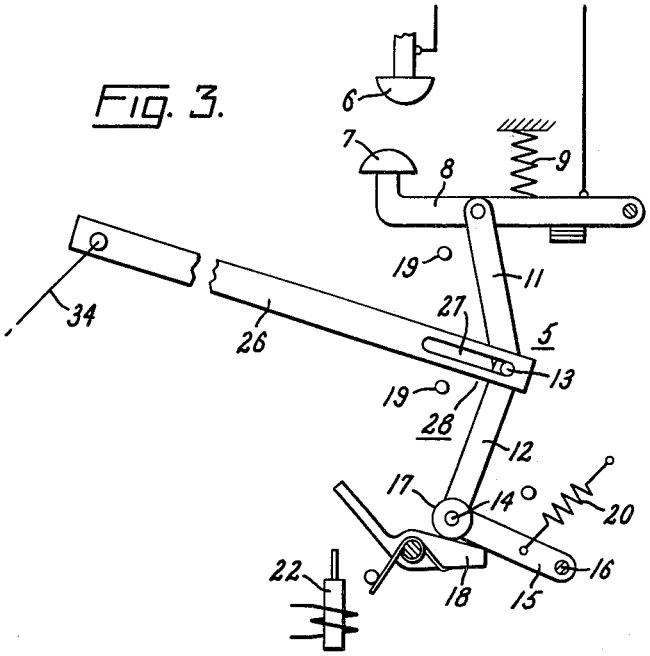
FIG. 3 shows the position of the parts when the circuit breaker has been tripped prior to recharging of the closing spring.

Should the circuit breaker be tripped by release of its trip latch 18, both toggle links 11 and 12 will move downwardly from their position of FIG. 2, causing the connecting link 26 to pivot clockwise about crank pin 34. The position of the parts after such tripping but before resetting of mechanism 5 is shown in FIG. 3. During and after such tripping of mechanism 5, the connecting link 26 is still free to reciprocate along its length without interference from the operating mechanism 5, thus allowing for the above-described oscillations of the spring controller 30 and for recharging of the closing spring. This freedom of the connecting link 26 to reciprocate is made possible by the presence of slot 27. Charging the closing spring moves link 26 to the right, and this allows the operating mechanism 5 to reset to its position of FIG. 1 under the influence of reset spring 20. The slot 27 allows resetting to be completed only when the crank pin 34 is close to its first (or right-hand) dead center position with respect to the closing spring. Resetting is completed when the trip latch 18 is restored to its position of FIG. 1 under the latch roller 17.

It will be apparent from the immediately-preceding paragraph that it is important for the link 26 to have the ability to pivot on crank pin 34 because such pivoting is needed in order to allow the circuit breaker to trip open in response to tripping of trip latch 18.

MODIFIED EMBODIMENT OF FIG. 5

In the embodiment illustrated in FIGS. 1–4, the linkage interconnecting the operating device 10 and the operating mechanism 5 consists for the most part of a single link 26. It is to be understood, however, that in certain applications, this linkage will be more complex and will include stroke-modifying means, such as stroke-modifying crank, which is shown at 100 in FIG. 5. The inclusion of such stroke-modifying means permits the stroke of the knee pin 13 to be different from that of the crank pin 34 of operating device 10 and permits more flexibility in selecting the spring stroke and force to provide the required closing energy.

In the embodiment of FIG. 5, the interconnecting linkage further comprises a first link **26*a* and a second link 26*b*. First link 26*a* is pivotally connected at its opposite ends to crank pin 34 and a pivot pin 102 on the crank 100. The second link 26 *b* is pivotally connected at its lower end to a pivot pin 104 on crank 100 and is coupled at its upper end to the knee pin 13 through a pin-and slot coupling 28 corresponding to the similarly-designated coupling of FIGS. 1–4**.

By modifying the ratio of such a crank 100, it is possible to use a single operating device 10 and operating mechanism 5 to produce a wide range of contact strokes, depending upon the specific application. To effect such a modification in crank ratio, the pivot pin 102 of FIG. 5 may be shifted to another opening 103 in the crank, thereby effectively lengthening one of the arms of the crank.

ADDITIONAL FEATURES

Figure 4A:
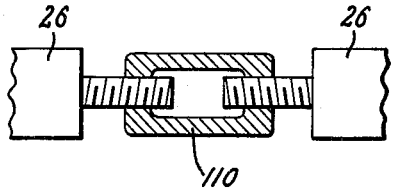
FIG. 4 is a schematic showing illustrating the circuit breaker mechanism fully closed and the spring controller 30 passing through a dead center position with respect to connecting link 26.
Figure 4:
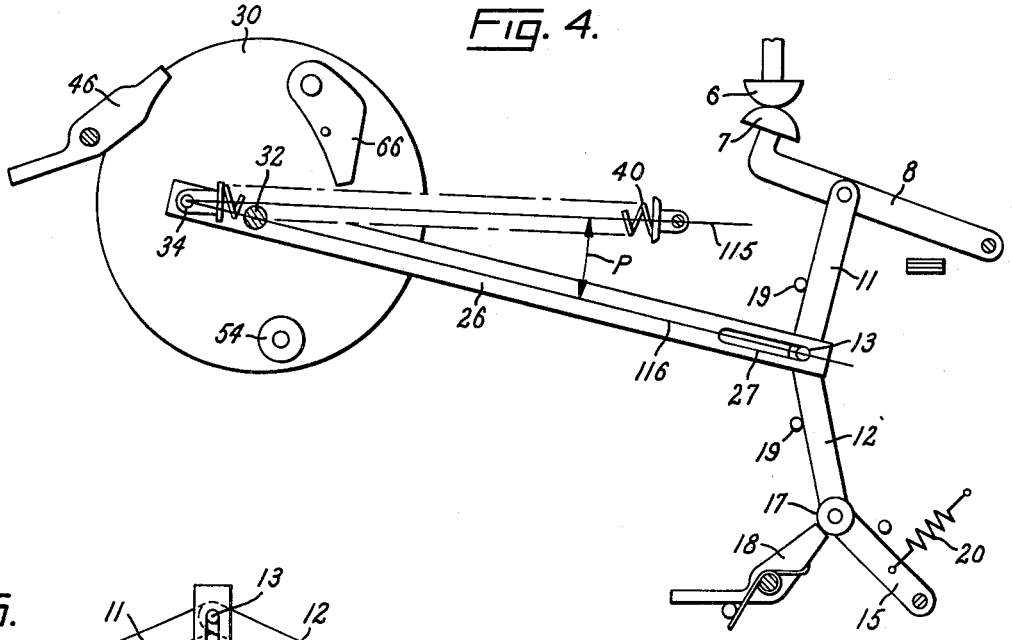

When the parts of the operating means are in their position of FIG. 4, there should be essentially no clearance between the right hand end of the slot 27 and the knee pin 13. To essentially eliminate such clearance when the parts are so disposed, I provide means (schematically shown in FIG. **4*a* but not in the other figures) for adjusting the effective length of the link 26. This adjusting means comprises a turnbuckle-like structure comprising a sleeve 110 oppositely threaded at its opposite ends and coupled to oppositely-threaded segments of connecting link 26. By appropriately rotating the sleeve 110 when the parts are in their position of FIG. 4, the effective length of the connecting link is changed and any clearance between the right hand end of slot 27 and pin 13 is essentially eliminated. Thus, the operating mechanism 5 is caused to rest on closing stops 19 when the spring-controller 30 enters its dead-center position of FIG. 4 with respect to the connecting link 26**.

Turning now to another feature, in the preferred embodiment shown, the toggle 11–13 of mechanism 5 is driven slightly overcenter during the final stage of the closing operation. While I could instead have designed the mechanism to fully close when the toggle reached a slightly undercenter position where it would be held by a spring-driven prop (as shown for example in U.S. Pat. Nos. 2,549,441-Favre or 3,835,277-Skreiner), the overcenter approach has a distinct advantage when used with my particular operating device 10. More specifically, in my arrangement, because of the slot 27 and the dead-center relationship depicted in FIG. 4, the application of closing force through connecting link 26 is discontinued as soon as the mechanism 5 reaches its fully-closed position. Despite this immediate discontinuance of closing force, the mechanism remains fully closed against the bias of opening spring 9. There is no need to continue applying closing force while waiting for any hold-closed prop to fall into place under knee 13. Since there is no such need, I am able to use the pin-and-slot coupling 28 combined with the dead-center relationship of FIG. 4 with no substantial risk of the mechanism accidentally bouncing open when the spring-controller 30 moves through its position of FIG. 4.

Turning to still another feature, an important relationship in the performance of my operating means is the phase angle P that is provided between the line of action 115 of the closing spring 40 and the line of action 116 of the connecting link 26, as seen in FIG. 4. This phase angle controls the speed of the movable contact just prior to its engagement with the stationary contact. It also controls acceleration of the moving contact at the start of a closing operation. My analysis of this operating means shows that this phase angle should be within the range of about ±20 degrees when the operating device 10 is in its position of FIG. 1. In other words, the spring-supporting pivot 42 should be so located that the line of action 115 is within about ±20 degrees from line 116 when the spring-controller 30 is in its latched position of FIG. 1.

While I have shown and described particular embodiments of my invention, it will be obvious to those skilled in the art that various changes and modifications may be made without departing from my invention in its broader aspects; and I, therefore, intend herein to cover all such changes and modifications as fall within the true spirit and scope of my invention.

I claim:

1. In operating means for a circuit breaker that comprises a pair of contacts, one of which is movable with respect to the other, (a) a circuit-breaker closing spring, (b) a rotatable spring-controller mounted for rotation between first and second angularly-spaced dead-center positions with respect to said spring, (c) means for transmitting charging forces to said spring in response to rotation of said spring-controller in a forward direction toward said first dead-center position, (d) means for forwardly rotating said spring-controller from said second to said first dead-center position, thereby charging said spring, (e) said spring acting to discharge and thereby further to rotate said spring-controller in a forward direction when said spring-controller has been rotated in a forward direction past said first dead-center position, (f) releasable stop means coacting with said spring-controller for blocking said further forward rotation of said spring-controller, said stop means being releasable to permit said spring to rapidly discharge and continue forward rotation of said spring-controller into said second dead-center position, (g) said spring-controller oscillating about said second dead-center position immediately following said rapid discharge of said spring, (h) means for closing said circuit breaker in response to forward rotation of said spring-controller into said second dead-center position comprising:

(h1) a mechanically trip-free operating mechanism coupled to said movable contact, (h2) a linkage interconnecting said spring-controller and said operating mechanism, (h3) pin and slot coupling means between said linkage and said operating mechanism which: (i) transmit closing force between said spring-controller and said operating mechanism during forward rotation of said spring-controller into said second dead-center position, (ii) allows said spring-controller to oscillate about said second dead-center position at the end of a closing operation without actuating said operating mechanism, whereby said circuit breaker can remain closed despite said oscillations, and (iii) allows said spring-controller to be forwardly moved from said second to said first dead-center position without actuating said operating mechanism, whereby said circuit breaker can remain closed during said charging of said closing spring, (i) and said linkage entering a dead-center position with respect to said spring-controller when said operating mechanism reaches a fully-closed position of the circuit breaker.

2. The operating means of claim 1 in which said linkage is related to said spring-controller in such a manner that said oscillations of the spring-controller produce no further motion of said linkage in a closing direction beyond the position occupied by said linkage when said operating mechanism is in a fully-closed position.

3. The apparatus of claim 1 in which:

(a) said means of (d), claim 1, comprises a driving member for said spring-controller and a drive between said driving member and said spring-controller for transmitting spring-charging forces between said driving member and said spring-controller, and (b) means is provided for rendering said drive ineffective to transmit driving forces between said driving member and said spring-controller during said oscillations of said spring-controller about said second dead-center position immediately following said rapid discharge of said spring.

4. The apparatus of claim 1 in which:

(a) said means of (d), claim 1, comprises a rotatable driving member for said spring-controller and a pawl-and-abutment drive between said driving member and said spring-controller, and (b) means is provided for rendering said pawl-and-abutment drive ineffective to transmit driving forces between said driving member and said spring-controller during said oscillations of said spring-controller about said second dead-center position immediately following said rapid discharge of said spring.

5. The apparatus of claim 1 in which:

(a) said means of (d), claim 1, comprises: a rotatable driving member for said spring-controller having an abutment thereon, and a pawl mounted on said spring-controller and arranged to be driven by said abutment when said driving member is driving said spring-controller in a forward direction from said second toward said first dead-center position, and (b) cam means is provided for acting during the oscillations immediately following spring-discharge to hold said pawl out of a path that will permit a collision between said pawl and said abutment during said oscillations.

6. The operating means of claim 1 in which:

(a) said linkage has a predetermined line of action with respect to said spring-controller, (b) said closing spring has a predetermined line of action with respect to said spring-controller, and (c) said predetermined lines of action intersect when said spring-controller is blocked by said releasable stop means, and a phase angle is then present between said lines of action of a value within the range of about ±20 degrees.

7. The operating means of claim 1 in which:

(a) said trip-free mechanism comprises a toggle which is driven toward an in-line position during a closing operation, and (b) said toggle is driven slightly past said in-line position when said linkage enters its dead-center position when said linkage enters its dead-center position with respect to said spring-controller at the end of a closing operation.

8. The operating means of claim 1 in which:

(a) said pin and slot coupling comprises a slot in said linkage and a pin coupled to said operating mechanism and slidably received within said slot, and (b) one end of said slot is used for driving said pin during a closing operation.

9. The operating means of claim 1 in which:

(a) said pin and slot coupling comprises a slot in said linkage and a pin coupled to said operating mechanism and slidably received within said slot, (b) one end of said slot is used for driving said pin during a closing operation, and (c) means is provided for adjusting the effective length of said linkage so that essentially no clearance is present between said driving end of said slot and said pin when said linkage enters its aforesaid dead-center position with respect to said spring-controller.

* * * * *